United States Patent [19]

Takano et al.

[11] Patent Number: 5,063,277

[45] Date of Patent: Nov. 5, 1991

[54] WATERPROOF AND DUSTPROOF PUSH SWITCH

[75] Inventors: T. Takano; Y. Kosuga; K. Sinzawa, all of Tokyo, Japan

[73] Assignee: Daiichi Denso Buhin Co., Ltd., Tokyo, Japan

[21] Appl. No.: 542,956

[22] Filed: Jun. 25, 1990

[30] Foreign Application Priority Data

Jun. 28, 1989 [JP] Japan ..... 1-76103
Aug. 2, 1989 [JP] Japan ..... 1-91141

[51] Int. Cl.[5] ..... H01H 13/12

[52] U.S. Cl. ..... 200/531.0; 200/302.2; 200/345

[58] Field of Search ..... 200/530, 531, 302.1, 200/302.2, 302.3, 345, 296; 277/DIG. 4, 212 FB

[56] References Cited

U.S. PATENT DOCUMENTS

| | | | |
|---|---|---|---|
| 3,104,300 | 9/1963 | Huff | 200/531 X |
| 3,316,379 | 4/1967 | Clarke et al. | 200/302.2 X |
| 3,663,780 | 5/1972 | Golbeck | 200/531 X |
| 3,818,169 | 6/1974 | Kobeinus | 200/531 |
| 3,989,912 | 11/1976 | Francke | 200/531 |
| 4,298,778 | 11/1981 | Beresfod-Jones | 200/302.2 |
| 4,652,706 | 3/1987 | Rao et al. | 200/302.2 X |
| 4,689,454 | 8/1987 | Schulte et al. | 200/345 X |
| 4,742,198 | 5/1988 | Martin et al. | 200/296 |
| 4,766,272 | 8/1988 | Guzzon | 200/531 X |
| 4,825,023 | 4/1989 | Morse | 200/302.2 |
| 4,982,062 | 1/1991 | Huerre et al. | 200/345 |

FOREIGN PATENT DOCUMENTS

| | | | |
|---|---|---|---|
| 2601206 | 7/1966 | Fed. Rep. of Germany | 200/531 |
| 63-82327 | 11/1986 | Japan . | |

*Primary Examiner*—Henry J. Recla
*Assistant Examiner*—Glenn T. Barrett
*Attorney, Agent, or Firm*—Nixon & Vanderhye

[57] ABSTRACT

A push switch includes an electrically insulating cylindrical base defining an interior space in which an actuator is movably disposed. Fixed contacts are associated with the base, while an inverted V-shaped contact is carried by the actuator so as to be capable of coming into contact with the fixed contacts and thereby making and breaking an associated electrical circuit. The base includes stepped detents which coact with terminal engagement ends associated with elastically deformable engagement legs of the actuator so as to limit the actuator's extent of movement. A resilient protective cap collectively covers an upper region of the insulating base and the actuator and is coupled to the base by a pin formed on the base being engaged within a recess formed in the cap.

11 Claims, 6 Drawing Sheets

WATERPROOF AND DUSTPROOF PUSH SWITCH

BACKGROUND OF THE INVENTION

1. Field of the Invention

The present invention relates to a waterproof and dustproof push switch and, more particularly, to a waterproof and dustproof push switch which can be easily assembled.

2. Prior Art

A conventional push switch has been disclosed, for example, in Japanese Utility Model Laid-Open No. 63-82327.

The conventional push switch according to Japanese Utility Model No. 63-82327 generally includes a body made of an insulating material having a fastening front plate and a hollow portion disposed in the central region thereof so that a shaft is inserted, through an end portion of the body, into the hollow portion. A first fixed contact member inserted and fastened to either of a pair of contact-member insertion holes is formed outside the hollow portion. A second fixed contact member is inserted and fastened to another contact-member insertion hole through another end portion of the body. A step-provided push shaft is inserted into the hollow portion so as to be supplied with a constant projecting elastic force toward the body by an elastic member. A movable contact member is secured to an end portion of the push shaft, inserted into the pair of contact-member insertion holes from an end portion of the body and arranged to have a pair of conductive elastic members so as to come in contact with the first fixed contact member and the second fixed contact member.

However, in the above-described conventional structure, a square projection at the end portion of the push shaft must be inserted into a square hole formed in the contact member when the movable contact member is fastened to the end portion of the push shaft. Therefore, assembly of the switch is not efficient since position-aligning and screw tightening tasks must be conducted.

Furthermore, when the push shaft is pushed, the movable contact member fastened to the end portion of the push shaft is forcibly moved outside the hollow portion of the body. Therefore, an insulating cover (which prevents contact with surround support structure to which the push switch is fastened becomes necessary. As a result, the number of the necessary components cannot be reduced, causing the overall cost to be raised undesirably.

In particular, since the above-described conventional structure has been arranged in such a manner that the waterproof cover is fastened to the body simply by fitting the groove of the waterproof cover to the flange of the body, the portion of the waterproof cover, other than the portion which is turned over at the time of mounting the body of the push switch on the vehicle body, can be easily separated. Therefore, a problem arises in that the working efficiency deteriorates critically.

Furthermore, it is necessary for the elastic member to be fastened to the push shaft prior to the fastening of the movable contact member to the push shaft. In addition, the movable contact member must be fastened to the push shaft against the urging force of the elastic member. Therefore, problems arise in that efficiency during assembly has been unsatisfactory. In addition, the assembly task itself has been dangerous since the elastic member can forcibly be ejected towards the worker.

SUMMARY OF THE INVENTION

An object of the present invention is to overcome the above-described problems. Therefore, a first object of the present invention is to provide a waterproof push switch arranged in such a manner that a movable contact is fastened to an activator in a one-touch mounting manner and the movable contact is movably disposed in an insulating cylindrical base. In particular, a fastening recessed portion (hole) formed in the waterproof cap is engaged to a fastening pin of the insulating cylindrical base so that the waterproof cap is fastened to the base. As a result, separation of the waterproof cap can be prevented even if the waterproof cap is partially turned over at the time the screw is fixed.

Another object of the present invention is to improve the assembling facility by inserting the movable contact into the pushing action side of the activator by inserting the activator into the insulating bottom-provided cylindrical base (i.e., in a so-called "one-touch mounting" manner) until a stepped portion of the insulating base is engaged with a respective one of the fastening elastic members. The engagement restricts the projection of the actuator above the base and reduces the overall cost of the switch by eliminating the necessity of the insulating cover.

The above-described objects can be achieved by the means claimed.

As a result, the waterproof cap can be fastened to the insulating cylindrical body by fastening the fastening recessed portion (hole) to the fastening pin of the insulating cylindrical body. Therefore, the waterproof cap cannot be easily separated even if the portion of the waterproof cap, which is fixed by the screw, is turned over when the screw is tightened for example.

In the push switch according to the present invention, the actuator is always elastically urged in a direction in which the actuator projects over the cylindrical base by means of a spring disposed in a space defined within the base. Furthermore, either of the elastic members of the substantially inverted V-shaped movable contact (which is associated operatively with the actuator) maybe positioned in contact with either of the fixed contacts (which are positioned within the hollow portion of the cylindrical base) while the other elastic member is in contact with the other fixed contact. Thus, when the above-described fixed contacts are electrically connected to each other via the movable contact, the push switch according to the present invention is switched on.

When the actuator is pushed into the cylindrical base against the urging force of the spring, one of the elastic member of the movable contact is separated from its respective fixed contact (which has a shorter length than that of the other fixed contact). Therefore, the push switch according to the present invention can be switched off since the fixed contacts are then electrically disconnected.

The extent of the projection of the actuator can be restricted since it comes into contact with stepped portions formed on the inner surface of the cylindrical base at the fastening elastic member thereof. Therefore, the separation of the actuator can be prevented and can be easily fastened into the bottom-base in a so-called "one-touch mounting" manner.

Other and further objects, features and advantages of the invention will be appear more fully from the following description.

BRIEF DESCRIPTION OF THE DRAWINGS

The accompanying drawings illustrate a first embodiment of the present invention, wherein.

DESCRIPTION OF THE PREFERRED EMBODIMENTS

Figure 1:
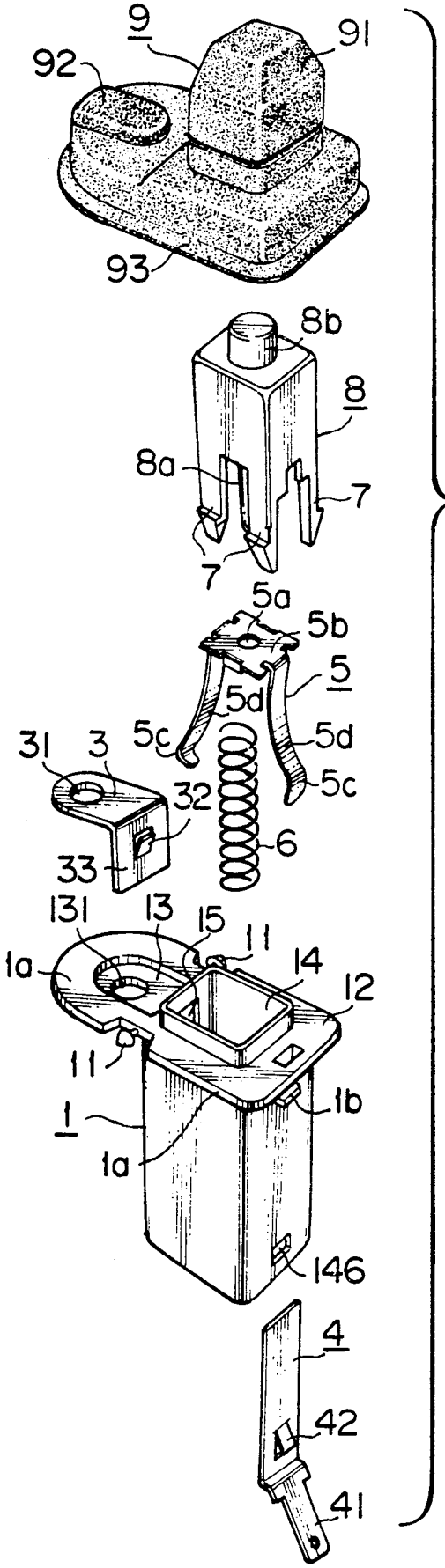
FIG. 1 is an exploded perspective view which illustrates a waterproof push switch.

Referring to the drawings, preferred embodiments of a waterproof push switch according to the present invention will now be described.

Figure 5A:
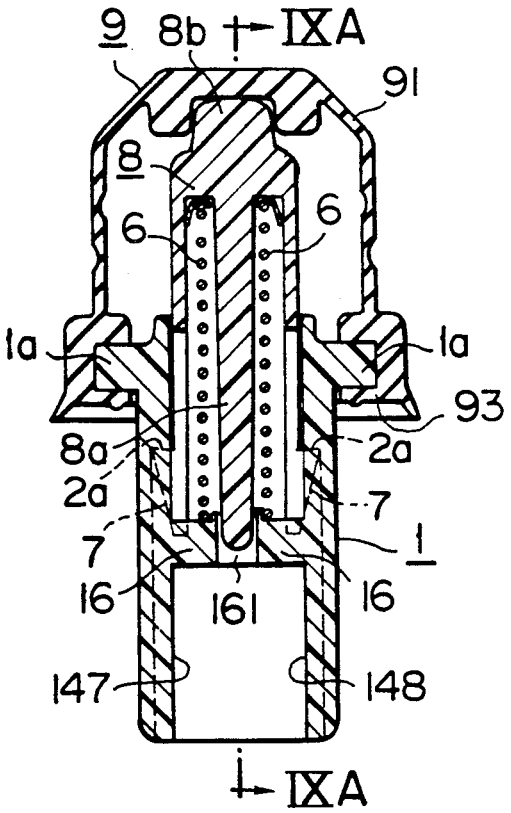
FIGS. 5A and 5B are vertical cross sectional elevational views which illustrate the central portion of the waterproof push switch.
Figure 9A:
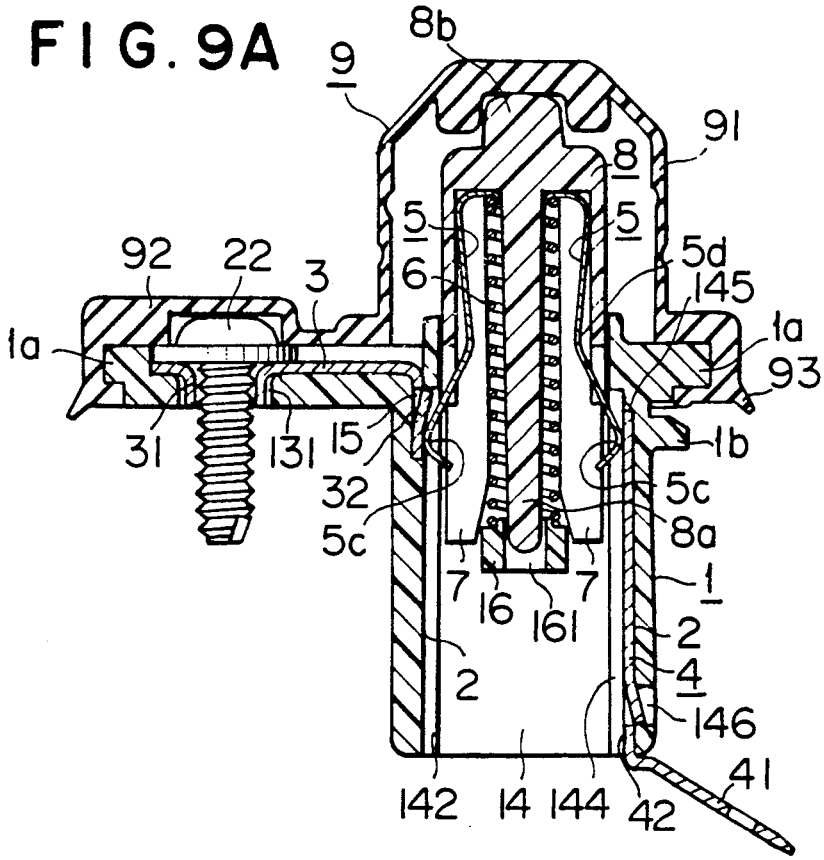
FIGS. 9A, 9B and 10 are vertical cross sectional side elevational views taken along respective cross sectional lines of FIGS. 5A, 5B and FIG. 6.
Figure 10:
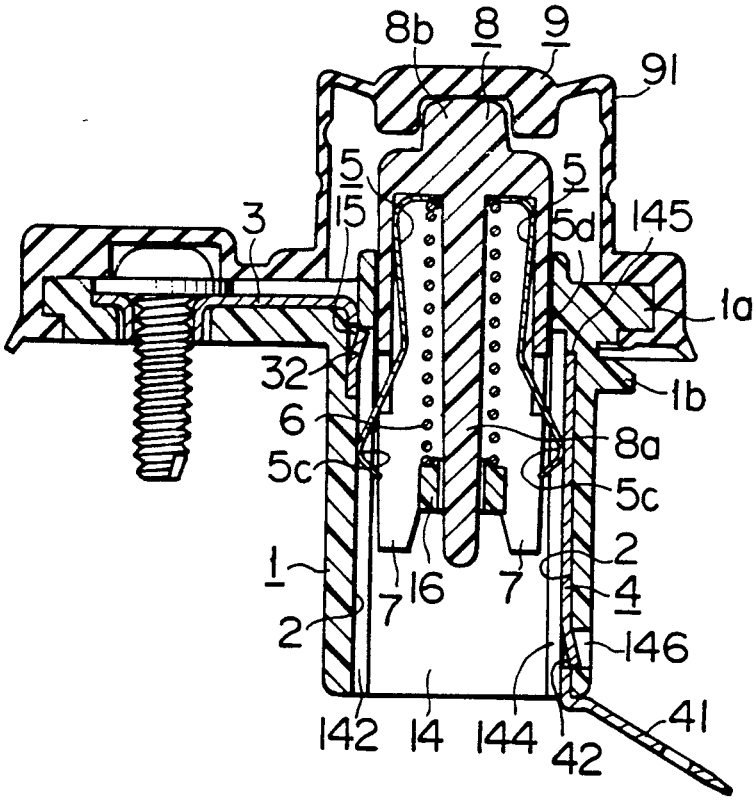

As shown in FIG. 1, the basic structures of the waterproof push switch according to the present invention include an electrically insulating cylindrical base 1 (made of a plastics material or the like) having an outer flange 1*a* . Furthermore, the waterproof push switch comprises a pair of fixed electrically conductive metal contacts 3 and 4 disposed so as to be positioned along at least a part of the confronting-inner walls 2 of the insulating cylindrical base 1 as shown in FIGS. 9A and 10. In addition, as shown in FIG. 9A, the waterproof push switch comprises a substantially inverted V-shaped movable electrically conductive metal contact 5 capable of coming into contact with each of the fixed contacts 3 and 4 as shown in FIG. 9A. Preferably, the movable contact 5 is formed of phosphor bronze or the like. The waterproof push switch further comprises a self-projecting type actuator 8 holding, as shown in FIG. 9A, a spring 6. The actuator 8 is inserted into the cylindrical base 1 as shown in FIGS. 5A and 9A, and as shown particularly in FIG. 5A, the actuator 8 is provided with fastening elastic members 7 or the like so that the separation of it is prevented (see also FIG. 1).

Figure 2:
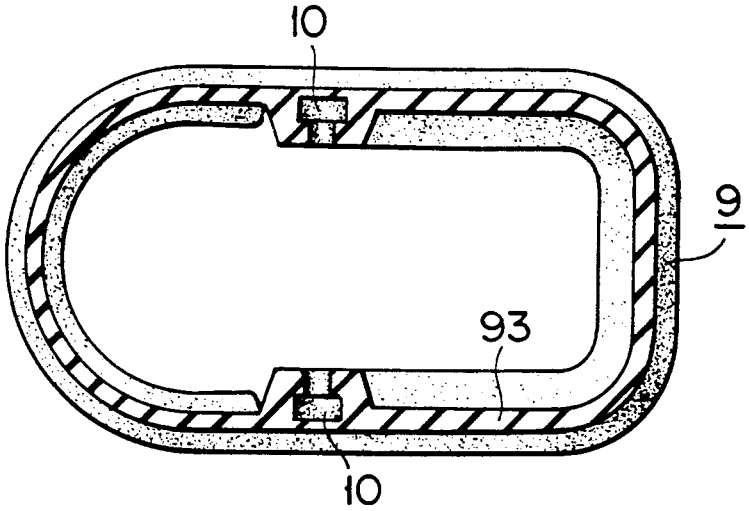
FIG. 2 is a lateral cross sectional plan view which illustrates the waterproof switch.
Figure 3:
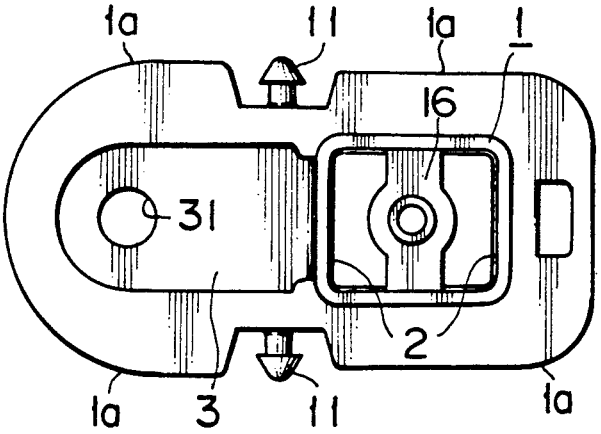
FIG. 3 is a plan view which illustrates an insulating cylindrical base.
Figure 4:
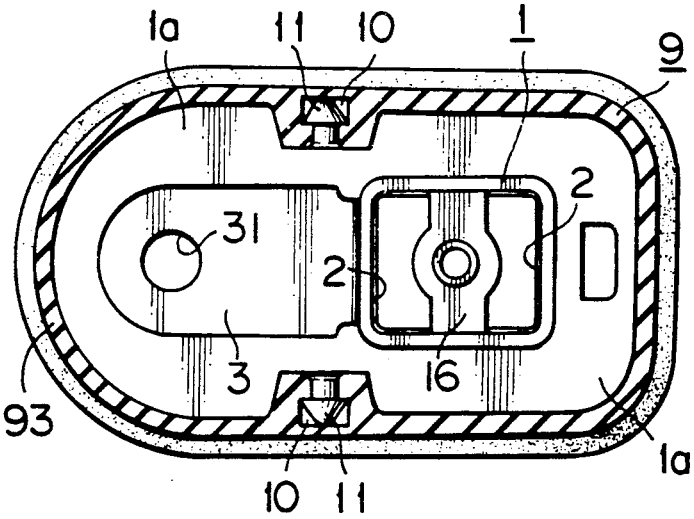
FIG. 4 is a lateral cross sectional plan view which illustrates an essential portion of a state in which the waterproof cap is fastened to the insulating cylindrical base.
Figure 7:
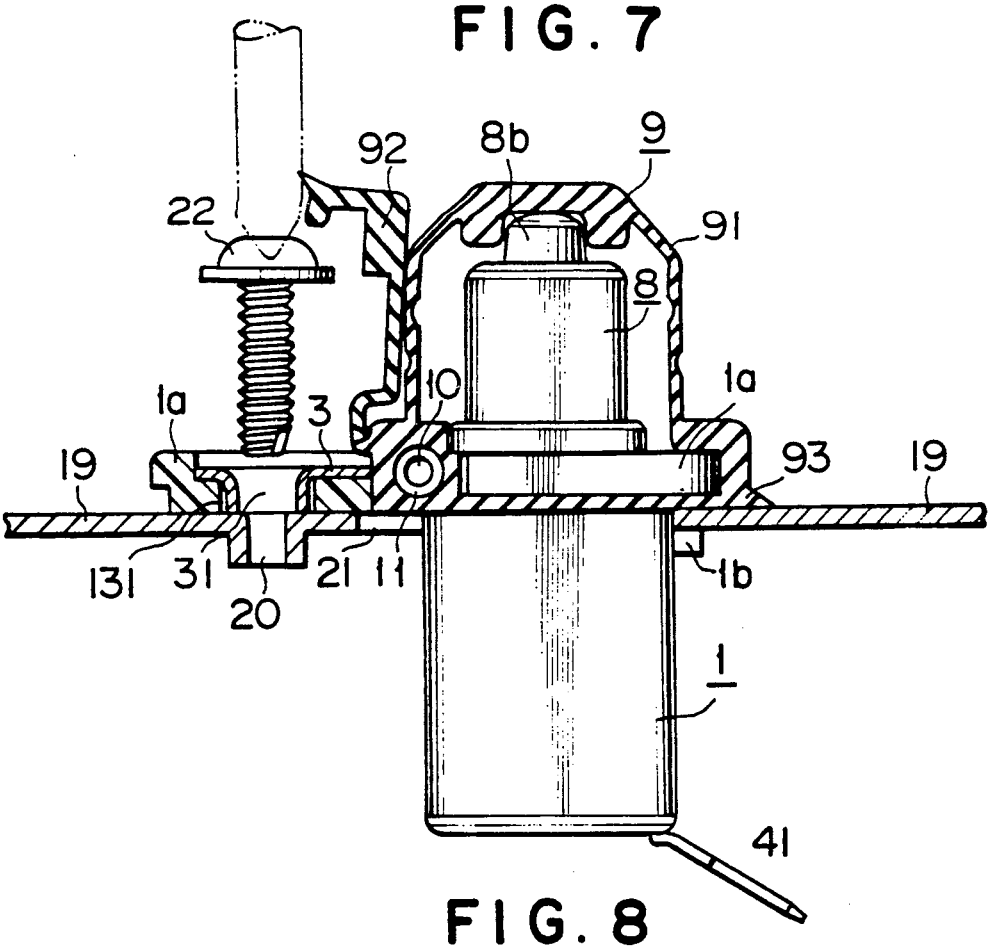
FIG. 7 is a side elevational view which illustrates a state in which the waterproof push switch is fastened to a fastening member, in which a portion is illustrated in a cross sectional view.

The outer flange 1a of the cylindrical base 1 including the portion above the actuator 8 is, as shown in FIGS. 4 and 9A, covered with a waterproof cap 9 arranged as shown in FIGS. 1 and 2 and made of soft rubber or the like. In addition, a fastening pin 11 is inserted into a fastening recessed portion (a fastening hole) 10 formed, as shown in FIG. 2, in the side surface of the waterproof cap 9 so that the separation of the waterproof cap 9 is prevented as shown in FIGS. 4 and 7. The fastening pins 11 are integrally positioned on the outer flange 1*a* as shown in FIG. 3.

The insulating cylindrical base 1 according to the present invention is molded out of a plastics material and is provided with an upper plate 12 having the outer flange 1*a* in the upper end portion thereof, the upper plate 12 acting to fasten the fixed contact 3. The upper plate 12 has a recessed portion 13 formed so as to fasten the fixed contact 3 and as well has a fixed-contact insertion hole 15 which communicates the recessed portion 13 to a rectangular hollow portion 14 of the insulating cylindrical base 1.

The confronting inner wall 2, in which the above-described fixed-contact insertion hole 15 is formed, has a groove 142 which comes in contact with either of the elastic members of a movable contact 5 to be described later. The other confronting inner wall 2 confronting the above-described inner wall 2 has a groove 144 which comes in contact with another elastic member of the movable contact 5 and as well has a fixed-contact insertion groove 145 and a fastening hole 146 in the bottom portion of the groove 144 and in the side wall of the same, respectively.

A spring retainer 16 is disposed between inner walls 147 and 148 of the hollow portion 14 which communicates with the confronting inner wall 2 at the intermediate position of the hollow portion 14. The spring retainer 16 includes a space between the confronting inner walls 2, the size of the space being sufficient for the pair of the fastening elastic member 7 of the actuator 8 to move. Furthermore, the spring retainer 16 has a hole 161 into which a guide shaft 8*a* of the movable contact 5 is inserted, the hole 161 being formed at the central portion thereof.

The above-described recessed portion 13 has a fastening hole 131 formed for the purpose of fastening the insulating cylindrical base 1 to a fastening member 19. The upper plate 12 has the outer flange 1*a* in the peripheral portion thereof for the purpose of fastening the waterproof cap 9.

The actuator 8 molded out of a plastics material includes a guide shaft 8*a* of a small diameter and a pushing shaft 8*b* the diameter of which is slightly larger than that of the guide shaft 8*a* and the length of which is sufficiently short. Furthermore, a movable-contact insertion hole 8*c* is formed in the pushing body 8 on the same side as the guide shaft 8*a*. The guide shaft 8*a* serves to retain the spring 6 and hold the movable contact 6 in the portion in which the guide shaft 8*a* and the pushing shaft 8*b* are connected to each other. The guide shaft 8*a* comes in contact with the inner walls 147 and 148 of the hollow portion 14 of the insulating cylindrical base 1 and the confronting inner walls 2 so that the rotation of the actuator 8 is prevented. The actuator 8 further comprises the fastening elastic members 7 which come into contact with the inner walls 147 and 148 of the rectangular hollow portion 14 and the confronting inner walls 2. Each of the fastening elastic members 7 each is sized and conformed so as to be capable of contacting a respective one of the stepped detent portions 2*a* of formed on the insulating cylindrical base 1.

The movable contact 5 is formed by an elongated conductive plate having elasticity made of, for example, phosphor bronze. The movable contact 5 comprises a base portion 5*b* having a shaft hole 5*a* at its central portion thereof into which the guide shaft 8*a* is inserted, the size of the base portion 5*b* being arranged so as to be inserted into the above-described rectangular movable-contact insertion hole 8*c*. A pair of elastic members 5*d* having contacts 5*c* are formed in a substantially inverted V-shape with the two sides bent similarly perpendicularly with respect to the central portion of the base portion 5*b*, the portions adjacent to the bent portions being further bent outwardly. Furthermore, the end portions of the elastic members 5*d* are respectively bent so as to be curved outwardly.

The fixed contact 4 has a plug portion 41 formed in such a manner that the width of an end portion of an elongated conductive plate, having the width with which it can be fitted within the fixed-contact insertion groove 145, is reduced by a certain quantity. The fixed contact 4 further comprises a fastening projection 42 formed by bending a portion of the large width side thereof.

The other fixed contact 3 is arranged in such a manner that an end portion of a conductive plate is formed so as to be fitted within the above-described recessed portion 13. Furthermore, a fastening hole 31 corresponding to the fastening hole 131 is formed in the fixed contact 3. The central portion of the fixed contact 3 is bent perpendicularly, while a contact portion 33 is formed in the another end portion of the conducting plate forming the fixing contact 3. The contact portion 33 has a fastening projection 22 which is arranged to be fastened to an enlarged opening portion which opens in the confronting inner wall 2 of the above-described fixed-contact insertion hole 15.

The waterproof cap 9 is made of natural or artificial rubber and comprises a cap main portion 91 which is able to partially cover the upper plate 12, the insulating cylindrical base 1 projecting over the upper plate 12 and the actuator 8. The waterproof cap 9 further comprises a projection portion 92 which covers a fastening screw 22. The cap main portion 91 has a flange 93 formed in the inner surface of the opening portion thereof, the flange 93 being fitted to the outer flange 1*a* of the upper plate 12. The flange 93 has the fastening recessed portion (hole) 10 into which the fastening pin 11, disposed in the outer flange portion of the insulating cylindrical base 1, is inserted.

As shown in FIGS. 5A and 9A, the waterproof push switch according to the present invention and thus constituted is assembled in such a manner that the guide shaft 8*a* of the actuator 8 is inserted into the shaft hole 5*a* formed in the movable contact 5. Then, the spring 6 is similarly inserted before insertions of the fixed contacts 3 and 4 into the fixed-contact insertion groove 145 and the fixed-contact insertion hole 15 through the opening portion of the insulating cylindrical base 1 on the side on which the upper plate 12 of the insulating cylindrical base 1 is formed adjacently and in which the fastening projections 32 and 42 are fastened to the fastening hole 146 and the edge of the hole formed in the enlarged opening portion and the edge of the opening of the same. The fixed-contacts 3 and 4 are inserted in such a manner that the spring 6 and the movable contact 5 are not separated and the elastic member 5*d* of the movable contact 5 is inwards contracted. Then, the guide shaft 8*a* of the pushing body 8 is inserted into the hole 161 formed in the spring retainer 16 and the fastening elastic member 7 is inserted into the insulating cylindrical base 1 so as to cause the fastening elastic member 7 to be fastened to the stepped portion 2*a*, the fastening elastic member 7 thus serving as a stopper for preventing the separation of the pushing body 8.

As shown in FIGS. 5 and 10, the waterproof push switch according to the present invention realizes the waterproof effect by fastening the flange 93 to the outer flange 1*a* of the upper plate 12 in such a manner that the pushing shaft 8*b* of the actuator 8 is covered.

As shown in FIGS. 7 and 9, the waterproof push switch according to the present invention is secured to a member 19 (for example, a metal member connected to either of the electrodes of the power source) to which the waterproof push switch is fastened by utilizing the fastening holes 20 and 21 previously formed in the member 19 in such a manner that the insulating cylindrical base 1 is inserted into the fastening hole 21. The member 19 is then fastened to the fastening projection 1*b* of the insulating cylindrical base 1. A portion of the waterproof cap 9 is then raised as shown in FIG. 7 so as to secure the upper plate 12 to the fastening member 19 when the screw 22 is driven into the screw hole 20 through the fastening hole 31 formed in the fixed contact 3 and the fastening hole 131 formed in the upper plate 12.

In this case, since the fastening pin 11 fastens the fastening recessed portion 10 formed in the waterproof cap 9, the waterproof cap 9 cannot be separated easily from the base 1 even if it is partially turned over (e.g., as shown in FIG. 7).

The waterproof push switch according to the present invention can be applied to, for example, a door switch for a vehicle. FIGS. 5A and 9A illustrate a state in which the door is opened, wherein the actuator 8 moves upwards in the insulating cylindrical base 1 until the fastening elastic member 7 comes in contact with the fastening elastic portion 2*a* by the urging force of the spring 6. The contact 5*c* of either of the elastic members 5*d* of the movable contact 5 is always positioned in contact with the contact portion 33 of the fixed contact 3, while the other contact 5*c* of the other elastic member 5*d* is always positioned in contact with the contact portion of the fixed contact 4. Therefore, the interior lamp is illuminated when the door is opened provided that the fastening member 19 is connected to the negative pole of the battery in the vehicle body and the plug portion 41 of the fixed contact 4 is connected to the positive pole of the battery via the interior lamp.

Figure 6:
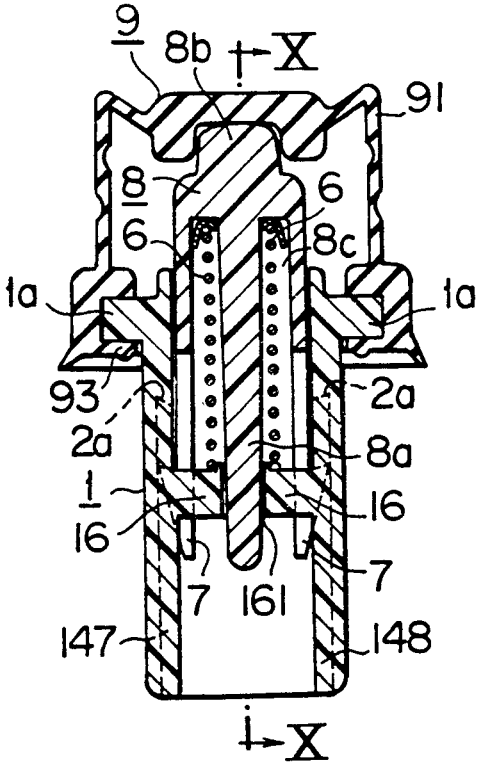
FIG. 6 is a vertical cross sectional elevational view which illustrates a state which is different from the state shown in FIG. 5A.

When the door is closed, the actuator 8 is, as shown in FIGS. 6 and 10, pushed inwardly within the base 1 by the door via the waterproof cap 9. As a result, the actuator 8 is inserted into the insulating cylindrical base 1 against the urging force of the spring 6. Therefore, the contact 5*c* of the elastic member 5*d* is separated from the contact portion 33 of the fixed contact 3, the contact 5*c* then being brought into contact with the confronting inner (and electrically insulating) wall 2 of the base 1. As a result, the interior lamp is extinguished even though the contact 5*c* of the other elastic member 5*d* is still in contact with the contact portion of the fixed contact 4.

The actuator 8 is able to smoothly vertically move within the base 1 since the fastening elastic members 7 only lightly comes into contact with the inner walls 147 and 148 of the hollow portion 14 and the confronting inner walls 2.

An embodiment of a dustproof push switch according to the present invention will be described with reference to the drawings.

As shown in FIGS. 1, 11, 12 and 5B, the dustproof push switch according to the present invention basically a closed-bottom electrically insulating cylindrical base 1 made of a plastics material having a fastening stepped portion 2*a* on the inner surface thereof. The dustproof push switch according to the present invention further comprises a pair of fixed metal contacts 3 and 4 and disposed so as to partially extend along the confronting inner walls 2 of the bottom-provided cylindrical body 1.

Figure 5B:
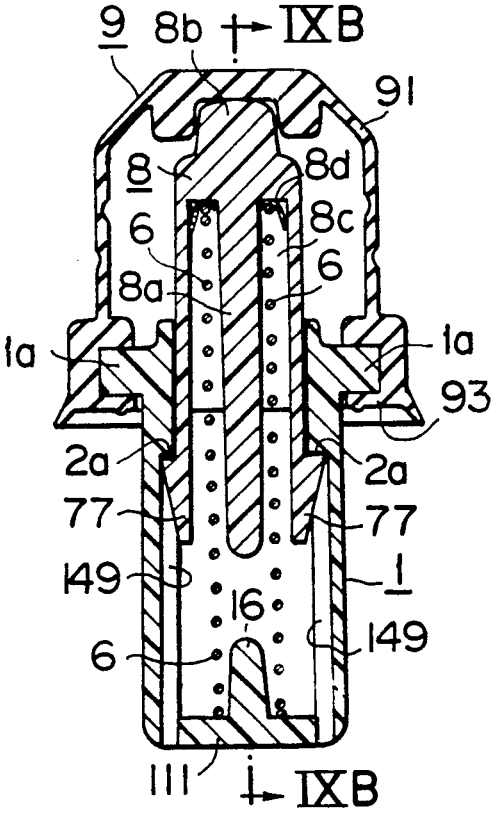
Figure 9B:
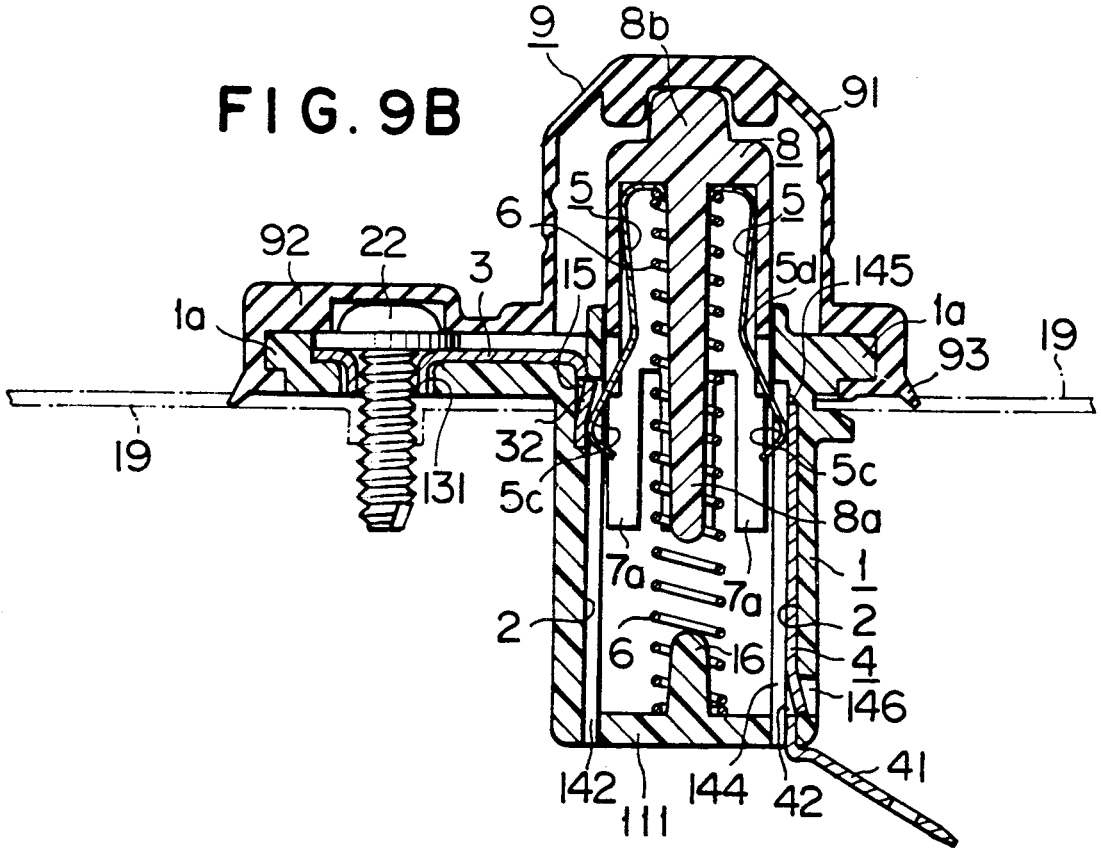

In addition, as shown in FIG. 9B, the dustproof push switch comprises the substantially inverted V-shaped movable contact 5 capable of coming in contact with each of the fixed contacts 3 and 4 as shown in FIG. 9B, the movable contact 5 being made of phosphor bronze or the like. Furthermore, the dustproof push switch comprises a self-projecting type actuator 8 holding, as shown in FIG. 9A, a spring 6 in a space defined within a bottom portion 111 of the cylindrical base 1. The actuator 8 is inserted into the cylindrical base 1 as shown in FIGS. 5B and 9B. The self-projecting actuator 8 comprises a fastening elastic member 77 fastened to the fastening stepped portion 2*a*.

As shown in FIG. 1, the cylindrical base 1 according to the present invention is molded from a plastics material and has the fastening upper plate 12 at the upper end portion thereof, the upper plate 12 having the outer flange 1*a*. The upper plate 12 has the recessed portion 13 for fastening the fixed contact 3 and the fixed-contact insertion hole 15 for communicating the recessed portion 13 with the rectangular hollow portion 14 of the cylindrical base 1.

Figure 8:
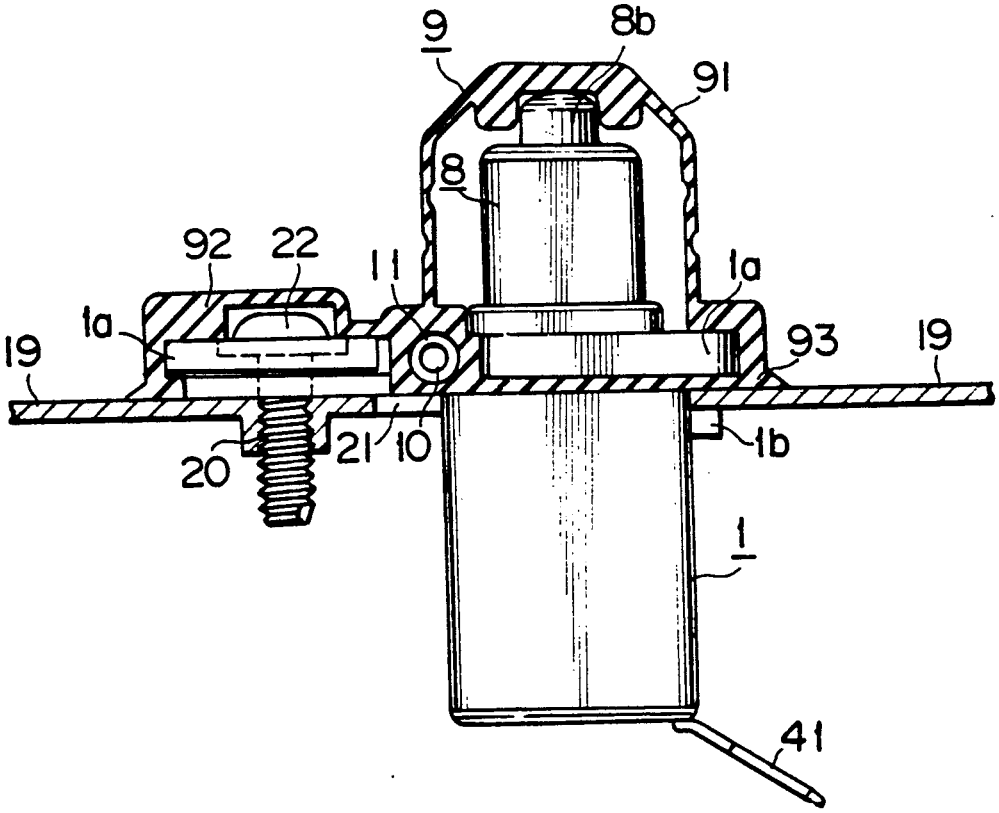
FIG. 8 is a side elevational view which illustrates a state in which the waterproof push switch has been fastened to the fastening member.

As shown in FIGS. 7 and 8, the opening confronting inner wall 2 of the fixed-contact insertion hole 15 has a groove 142 so as to come into contact with either of the elastic members of the movable contact 5 to be described later. The other confronting inner wall 2 has a groove 144 so as to come contact with the other elastic member. Furthermore, the fixed-contact insertion groove 145 and the fastening hole 146 are, as illustrated, formed in the bottom portion of the groove 144 and the side wall of the same, respectively.

As shown in FIG. 1, the recessed portion 13 has the fastening hole 131 formed for the purpose of fastening the cylindrical base 1 to the fastening member 19. Furthermore, the peripheral portion of the upper plate 12 has the outer flange la for the purpose of fastening the waterproof cap 9.

Figure 11:
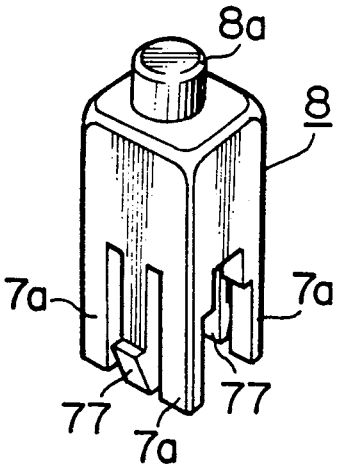
FIG. 11 is a perspective view which illustrates the pushing body.
Figure 12:
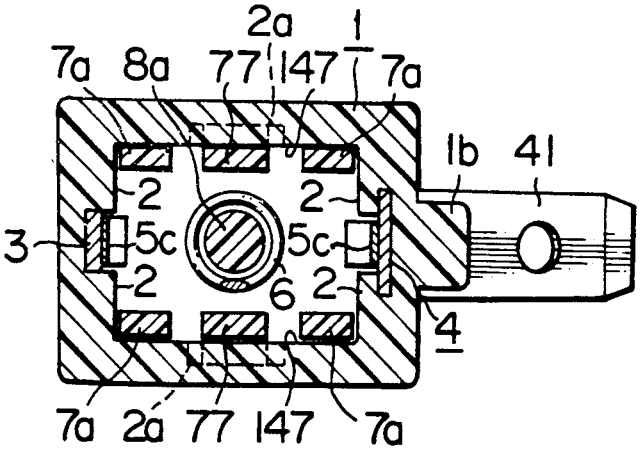
FIG. 12 is lateral cross sectional plan view which illustrates the central portion of the push switch.

As shown in FIGS. 11 and 12, the actuator 8 is molded from a plastics material and in the form of a substantially rectangular shape. The actuator 8 comprises an elongated guide shaft 8*a* having a small diameter and a pushing shaft 8*b* having a diameter larger than the diameter of the guide shaft 8*a* and the length of which is sufficiently short. In addition, a holding portion 8*d* for holding the spring 6 and the movable contact 5 is formed in the portion in which the pushing shaft 8*b* and the guide shaft 8*a* are connected to each other. Furthermore, four projecting guide members 7*a* are formed so as to be positioned in contact with four corners of inner walls 149 and the confronting inner walls 2 of the hollow portion 14 of the bottom-provided cylindrical base 1, the four guide members 7*a* acting to prevent the rotation of the actuator 8.

Two fastening elastic members 77 are formed in the actuator 8, the fastening elastic members 77 having a size which can be fastened to the stepped detent portions 2*a* formed in the upper region of the inner walls 149 of the hollow portion 14 of the cylindrical base 1.

As shown in FIGS. 3 and 7, the thus arranged dustproof switch according to the present invention is assembled in such a manner that the guide shaft 8*a* of the actuator 8 is inserted into the shaft hole 5*a* of the movable contact 5 and the spring 6 is similarly inserted.

The fixed contacts 3 and 4 are inserted into the respective fixed-contact insertion groove 145 and the fixed-contact insertion hole 15 through the opening portion of the bottom provided cylindrical base 1 in which the fastening projections 32 and 42 are fastened to the edges of the fastening hole 146, the enlarged opening portion and the edge of the opening. The fixed contacts 3 and 4 are inserted in such a manner that the spring 6 and the movable contact 5 are not separated and the elastic member 5*d* of the movable contact 5 inwardly contracts. The fastening elastic members 7 are then continuously inserted into the cylindrical base 1 against the urging force of the spring 6 and slightly warp inwardly against the fastening members inherent elastic force. As a result, the fastening elastic members 7 are coupled to the fastening stepped portion 1*a* in a snap-fit manner by their own elastic force. As a result, separation of the actuator 8 is prevented.

The waterproof push switch according to the present invention allows the movable contact to be easily fastened to the actuator, thereby increasing assembly efficiently. Another effect can be obtained in that the necessity of providing the insulating cover can be eliminated since the movable contact does not appear outside the insulating cylindrical base. In particular, according to the present invention, the fastening pin disposed in the outer flange portion of the insulating cylindrical base is inserted into the fastening recessed portion (hole) formed in the waterproof cap. In such a manner, the waterproof cap is thereby fastened to the outer flange. Therefore, when the outer flange is fastened to the vehicle body panel or the like by using a screw, the removal of the whole waterproof cap can be prevented due to the fastening recessed portion (hole) of the waterproof cap being fastened to the fastening pin. This benefit is present even when that portion of the waterproof cap fastened by the screw is raised as shown in FIG. 7. As a result, the waterproof cap cannot be easily separated from the outer flange of the insulating cylindrical body. Consequently, fastening the screws to underlying support structure can be easily completed.

According to the dustproof push switch according to the present invention, the fastening elastic member of the self-projecting actuator having a spring is fastened and secured by the fastening stepped portion formed on the inner surface of the cylindrical base. As a result, the amount of the projection of the actuator can be restricted and its separation can thereby be prevented. The actuator can be significantly easily fastened into the cylindrical base in a so-called "one touch mounting" manner, which facilitates automation of the assembly.

Furthermore, since the movable contact is arranged in such a manner that it can be moved in the insulating cylindrical base, the necessity of providing a dustproof insulating cover which also serves to prevent short-circuit accident can be eliminated. Therefore, cost and space-saving benefits ensue.

Although the invention has been described in its preferred form with a certain degree of particularity, it is understood that the present disclosure of the preferred form may be changed in the details of construction and the combination and arrangement of parts may be resorted to without departing from the spirit and the scope of the invention hereinafter claimed.

What is claimed is:

1. A waterproof switch comprising:

an electrically insulating cylindrical base having an outer flange and confronting inner walls defining an interior space;

fixed contacts disposed to as to partially extend along respective said inner walls of said insulating cylindrical base;

an actuator movably disposed within said defined interior space of said base;

said actuator having a substantially inverted V-shaped contact which is movable with said actuator and is thereby adapted to come into contact with each of said fixed contacts to make an electrical circuit when said actuator is moved into an on position;

a spring disposed within said interior space and exerting a bias force upon said actuator;

a resilient waterproof cap having a side region which defines a recess, said cap being disposed so as to cover said actuator and said outer flange of said insulating cylindrical body; wherein said outer flange of said insulating base includes a fastening pin which is accepted within said recess defined within said side region of said waterproof cap so as to prevent separation of said waterproof cap from said insulating base.

2. A switch as in claim 1, wherein said base includes stepped detents extending into said defined interior space; and said actuator includes at least one pair of elastically deformable engagement leg members having terminal engagement ends which come into contact with said stepped detents of said base to thereby limit movement of said actuator within said interior space.

3. A switch as in claim 1 or 2, wherein said outer flange includes a lateral mounting flange member which defines a mounting hole adapted to accept a screw therethrough and thereby couple said switch to underlying support structure, and wherein said resilient waterproof cap includes a screw-covering portion which covers said lateral mounting flange and the screw which is accepted within said mounting hole, said screw-covering portion being foldable relative to said waterproof cap in the region of said coupled pin and recess to thereby expose said mounting screw.

4. A dustproof push switch comprising:

an insulating cylindrical base having confronting inner walls and a stepped detent portion formed on the inner walls;

a pair of fixed contacts disposed to as to partially extend along respective said inner walls of said insulating cylindrical base; and an actuator movably disposed within said defined interior space of said base;

a resilient cap which covers said actuator, said cap including a side region which defines a recess;

said base includes a pin which is received within said recess defined by said cap side region to prevent separation of said cap from said actuator;

said actuator having a substantially inverted V-shaped contact which is movable with said actuator and is thereby adapted to come into contact with each of said fixed contacts to make an electrical circuit when said actuator is moved into an on position; wherein said actuator further includes at least one pair of elastically deformable engagement leg members having terminal engagement ends which come into contact with said stepped detents of said base when said actuator is moved to said on position to thereby limit movement of said actuator within said interior space.

5. A switch as in claim 4, wherein said cap includes a pair of said recesses and said base includes a pair of said pins.

6. A push-switch comprising:

an electrically insulating base defining an interior space;

a pair of fixed electrical contacts a portion of which is exposed to said interior space;

a movable actuator disposed within said interior space having a pair of movable contacts which are adapted to make and break an electrical circuit with said fixed contacts when said actuator is moved into on and off positions, respectively; and a flexible cap which collectively covers an upper region of said base and said movable actuator, and includes a side region which defines a recess; wherein said insulating base includes a pin which is engaged with said recess so as to couple said cap to said base.

7. A push-switch as in claim 6, wherein said base includes a pair of said pins, and said cap includes a pair of said recesses in which said pins are engaged.

8. A push-switch as in claim 6 or 7, wherein said base includes a transverse mounting flange adapted to mounting the base to underlying support structure via a mounting screw, and wherein said cap includes a laterally extending portion for covering the mounting screw and said mounting flange.

9. A push-switch as in claim 6, where said base includes stepped detents in said interior space, and said actuator further includes at least one pair of elastically deformable engagement leg members having terminal engagement ends which come into contact with said stepped detents of said base when said actuator is moved to one of said on and off positions to thereby limit movement of said actuator within said interior space.

10. A push-switch as in claim 9, wherein said movable contact is an inverted V-shaped electrical contact member.

11. A push-switch as in claim 6, which further comprises a spring which exerts a bias force upon said actuator in a direction tending to move said actuator into said on position.

* * * * *